United States Patent [19]

Norton

[11] Patent Number: 4,860,977

[45] Date of Patent: Aug. 29, 1989

[54] RAILWAY SIGNALLING SYSTEM

[75] Inventor: David J. Norton, Poole, United Kingdom

[73] Assignee: Westinghouse Brake & Signal Co. Ltd., Chippenham, United Kingdom

[21] Appl. No.: 76,108

[22] Filed: Jul. 21, 1987

[30] Foreign Application Priority Data

Jul. 24, 1986 [GB] United Kingdom ..... 8618112

[51] Int. Cl.[4] ..... B61L 27/00

[52] U.S. Cl. ..... 246/3; 246/218; 246/473 R

[58] Field of Search ..... 246/2 R, 3, 28 F, 218, 246/219, 220, 473 R

[56] References Cited

U.S. PATENT DOCUMENTS 3,740,548 6/1973 Hoyler ..... 246/3
4,611,775 9/1986 Petit ..... 246/220

FOREIGN PATENT DOCUMENTS 0036960 10/1981 European Pat. Off. .
0108311 5/1984 European Pat. Off. .
0108363 5/1984 European Pat. Off. .
1401651 7/1975 United Kingdom .
1426283 2/1976 United Kingdom .

OTHER PUBLICATIONS

Cribbens et al: "An Experimental Application of Microprocessors to Railway Signalling", Electronics and Power, Mar. 1978.
Cribbens et al: "An Experimental Railway Signalling System Using Microprocessors", published by British Railways Board, Sep. 1977.
Cribbens et al: "The Solid State Interlocking Project", Proceedings International Conference on Railways in the Electronic Age, Publication No. 203, IEE, London, U.K., Nov. 1981.
Cribbens et al: "Solid State Interlocking", Second International Symposium on Advanced Propulsion and Control for Urban Transit, Baltimore, Md., Feb. 1984.
Cribbens et al: "The Microprocessor as a Railway Control System Component", British Railways Board, Sep. 1976.
Cribbens: "The Solid State Interlocking", I.R.S.E., International Conference on Railway Control and Automation Towards the Twenty First Century, London, Sep. 1984.

*Primary Examiner*—Ronald C. Capossela
*Attorney, Agent, or Firm*—Nilsson, Robbins, Dalgarn, Berliner, Carson & Wurst

[57] ABSTRACT

A railway signalling system includes a plurality of trackside equipments (11,12) and means (1,2,3,4,6, 15,16) for transmitting control information to the equipments and receiving status information therefrom, each of the trackside equipments being provided with a respective microprocessor (13 or 14) via which such control information is transmitted from the said means to the equipment and via which such status information is received by said means from the equipment.

13 Claims, 2 Drawing Sheets

RAILWAY SIGNALLING SYSTEM

The present invention relates to a railway signalling system, more particularly one in which information is transmitted to and from trackside equipment such as sets of single lights and/or points machines.

Problems associated with the transmission of information to and from trackside equipment in a railway signalling system are the installation of the signalling means, the cost of testing of the signalling means after installation, and maintenance of the overall system, including the signalling means.

According to the present invention, there is provided a railway signalling system including a plurality of trackside equipments and means for transmitting control information to the equipments and receiving status information therefrom, wherein each of the trackside equipments is provided at the trackside with a respective microprocessor via which such control information is transmitted from the said means to the equipment and via which such status information is received by said means from the equipment.

Figure 1:
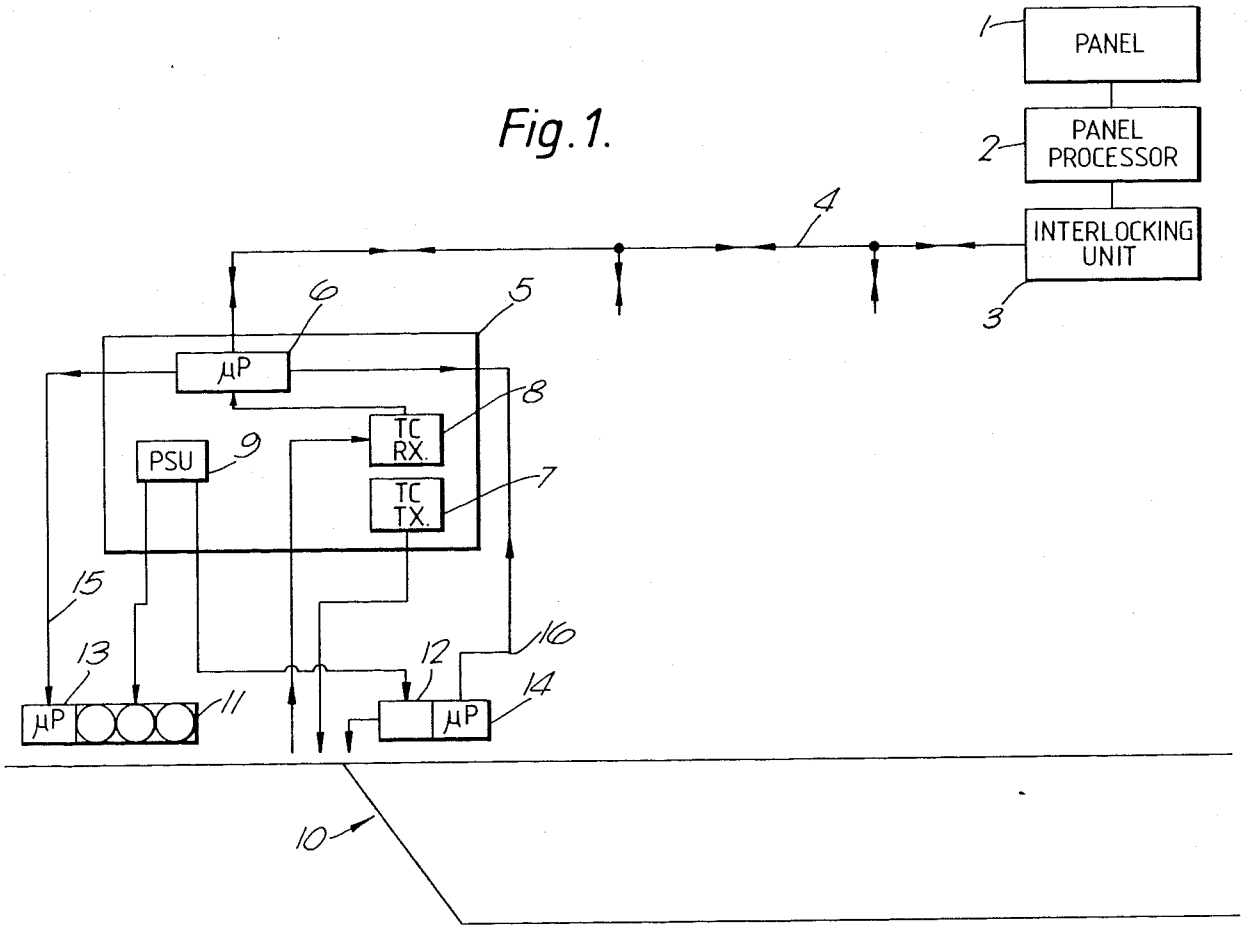
Figure 2:
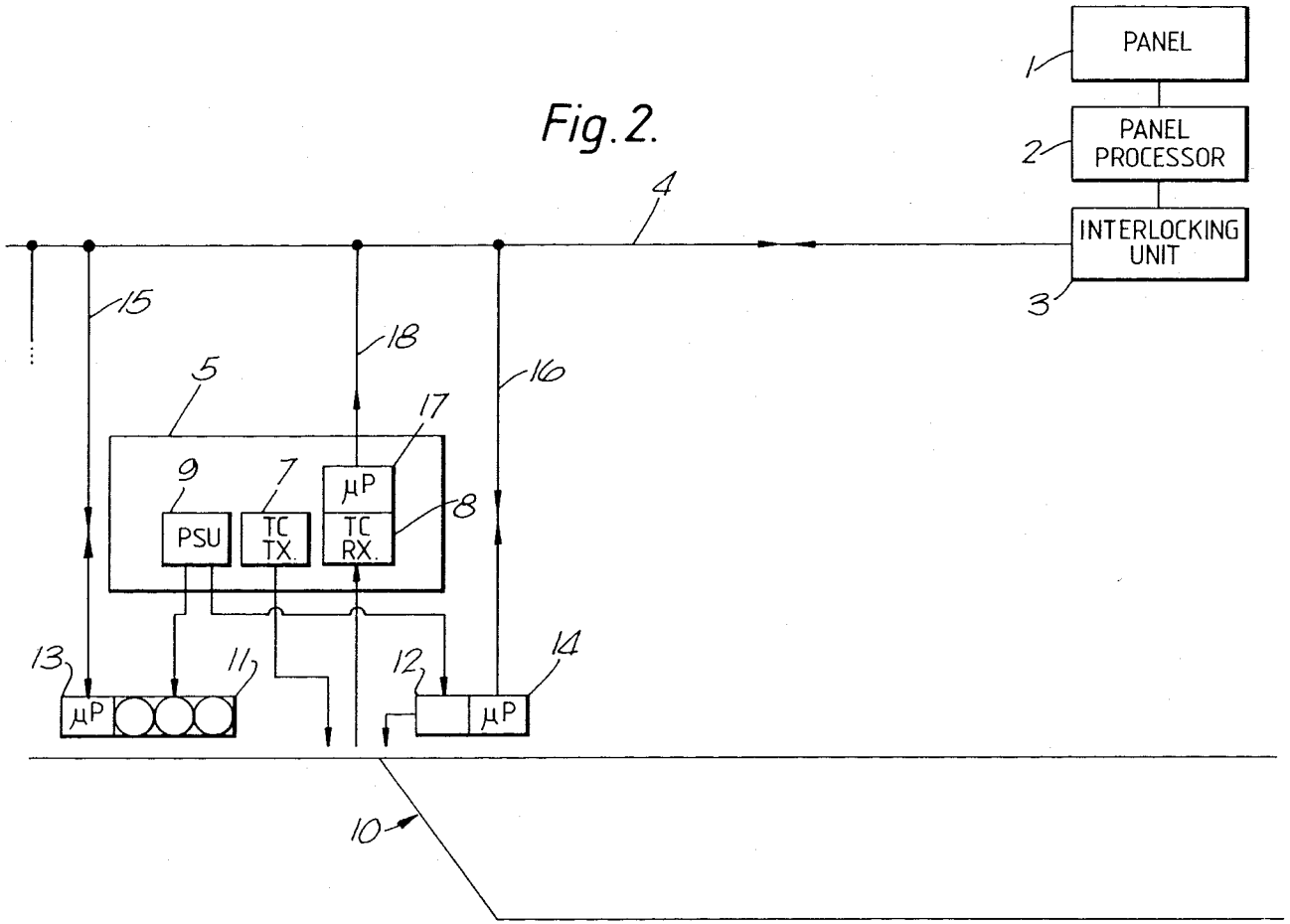

The present invention will now be described, by way of example, with reference to the accompanying drawings, in which:

FIG. 1 is a block diagram of a system embodying an example of the invention; and FIG. 2 is a block diagram of a modified version of the system of FIG. 1.

Referring to FIG. 1, one example of a railway signalling system embodying the present invention is illustrated. A panel 1 at a central control station is used for setting up routes in the system by setting up conditions for sets of trackside signal lights and trackside points machines in the system. Panel 1 interfaces via a panel processor 2 with an interlocking unit 3 from which control data for the sets of signal lights and points machines is sent and which receives data related to the status of the sets of signal lights and points machines. The interlocking unit 3 operates according to predetermined safety routines, and data is sent to and from it via a bi-directional communication link, in the example a physical link 4 which could be a pair of optical fibres or a pair of twisted wires.

Coupled to the link 4 are a plurality of cases 5 (only one shown). In each case 5 respectively there are: a miroprocessor 6; a track circuit transmitter 7; a track circuit receiver 8; and a power supply unit 9 for energising microprocessor 6, transmitter 7 and receiver 8 by suitable low voltages. Reference numeral 10 denotes a section of railway track having a plurality of sets of trackside signal lights 11 and trackside points machines 12 (only one of each being shown). In FIG. 1, components in one case 5 are shown as controlling one set of signal lights 11 and one points machine 12, although they could control up to four or five of each for example. Each set of signal lights 11 and each points machine 12 is supplied with a suitable high voltage from the power supply unit 9 of the associated case 5. Also, each set of signal lights 11 is provided with a respective microprocessor 13 and each points machine 12 is provided with a respective microprocessor 14. Each microprocessor 13 is coupled via a bi-directional communication link 15 (for example, a pair of twisted wires or a pair of optical fibres) with the microprocessor 6 of the associated case 5; and each microprocessor 14 is coupled via a bi-directional communication link 16 (for example, a pair of twisted wires or a pair of optical fibres) with the microprocessor 6 of the associated case.

In operation of the system, the interlocking unit 3 serially transmits coded control data via the link 4, the data destined for each case 5 being coded accordingly. The microprocessor 6 of each case 5 decodes the data intended for the respective case and issues control instructions via the or each link 15 and the or each link 16. On receipt of an instruction via the respective link 15 (for example, "Illuminate green light"), each microprocessor 13 causes its set of signal lights 11 to assume the appropriate condition and the microprocessor signals back to the microprocessor 6 via the link 15 that the appropriate condition has been assumed (for example, "Green light illuminated"). On receipt of an instruction via the respective link 16 (for example, "Set points to normal"), each microprocessor 14 causes its points machine to assume the appropriate condition and the microprocessor signals back to the microprocessor 6 via the link 16 that the appropriate condition has been assumed (for example, "Points set to normal"). Also, each microprocessor 13 and each microprocessor 14 signals back via its link 15 or 16 to the microprocessor 6 of the associated case 5 information reporting on self-testing routines it carries out on itself. The microprocessor 6 of each case 5 also receives information from the respective track circuit receiver 8, the latter receiving information from a respective track circuit fed from the track circuit transmitter 7 of the case 5.

Finally, each microprocessor 6 transmits to the interlocking unit 3 via the link 4 data related to the information received via the or each link 15 and the or each link 16 and from the track circuit receiver 8.

In the system of FIG. 2, each of cases 5 does not include a microprocessor 6. Instead the microprocessors 13 and 14 are adapted to cummunicate directly with the interlocking unit 3 via their bi-directional communication links 15 and 16 and the link 4; and each track circuit receiver 8 has a microprocessor 17 which sends data from the receiver to the interlocking unit 3 via a communication link 18 (for example, a wire or an optical fibre) and the link 4. Instead of power supply units 9 supplying high voltage to the sets of signal lights 11 and points machines 12, each of the latter could have its own respective power supply unit for this purpose.

Advantages of the above-described systems are ease of installation and reduced costs of wiring and installation; reduced testing costs on site after installation sine the use of microprocessors enables full testing prior to despatch and installation of equipment; and reduced overall system engineering costs.

I claim:

1. A railway signalling system comprising;

a plurality of trackside equipments;

means for transmitting control information to said equipments and for receiving status information therefrom;

microprocessor means coupled to each of said trackside equipment; and means coupling said microprocessor means to said means for transmitting and receiving for transmitting said control information to said equipment through said microprocessor means and for receiving said status information from said equipment through said microprocessor means.

2. A system according to claim 1, wherein the said means for transmitting control information and receiving status information comprises means at a control station for setting up routes within the system and a bi-directional communication link through which the said means communicates with the microprocessors and the latter communicate with the said means.

3. A system according to claim 2, wherein the said bi-directional link comprises a pair of twisted wires.

4. A system according to claim 2, wherein the said bi-directional link comprises an optical fibre.

5. A system according to claim 2, wherein at least some of the said trackside equipments are arranged in a group, there being provided for the said group, common control apparatus which includes a further microprocessor coupled to said bi-directional link for communication therewith, a respective bi-directional communication link connected between each said respective microprocessor of each of the trackside equipments of the group and said further microprocessor for communicating with the further microprocessor.

6. A system according to claim 5, wherein the respective bi-directional communication link of the microprocessor of at least one of the trackside equipments of the said group comprises a pair of twisted wires.

7. A system according to claim 5, wherein the respective bi-directional communication link of the microprocessor of at least one of the trackside equipments of the said group comprises an optical fibre.

8. A system according to claim 2, wherein the microprocessor of at least some of the said trackside equipments are provided with respective bi-directional communication links through which they communicate directly with the first-mentioned bi-directional communication link.

9. A system according to claim 8, wherein at least one of the said respective bi-directional communication links comprises a pair of twisted wires.

10. A system according to claim 8, wherein at least one of the said respective bi-directional communication links comprises an optical fibre.

11. A system according to claim 1, wherein at least some of the said trackside equipments comprise sets of signal lights.

12. A system according to claim 1, wherein at least some of the said trackside equipments comprise points machines.

13. A railway signalling system comprising;

(a) a plurality of sets of trackside signal lights each having a microprocessor connected thereto;

(b) a plurality of trackside points machines each having a microprocessor connected thereto;

(c) first means for transmitting control information to the said sets of signal lights and points machines and receiving status information therefrom, including;

(d) second means at a control station for setting up routes within the system and a bi-directional communication link coupled between said first means and said microprocessors through which the said first means communicates with said microprocessors to transmit control information from said first means to the set of signal lights and the points machine and said microprocessors communicate with said first means so that status information is received by said first means from the set of signal lights and the points machines.

* * * * *